United States Patent [19]

Mazzorana

[11] Patent Number: 4,637,267

[45] Date of Patent: Jan. 20, 1987

[54] ENGAGEMENT CONTROL OF THE STARTER PINION FOR INTERNAL COMBUSTION ENGINE STARTER

[75] Inventor: Alfred B. Mazzorana, Venissieux, France

[73] Assignee: Societe de Paris et du Rhone, Lyons, France

[21] Appl. No.: 753,606

[22] Filed: Jul. 10, 1985

[30] Foreign Application Priority Data

Jul. 10, 1984 [FR] France ..... 84 11324

[51] Int. Cl.[4] ..... F02N 15/06; H01H 50/20

[52] U.S. Cl. ..... 74/7 A; 335/131

[58] Field of Search ..... 74/7 A; 290/38 C, 48; 335/131

[56] References Cited

U.S. PATENT DOCUMENTS 4,116,077 9/1978 Mazzorana ..... 74/7 A
4,356,735 11/1982 Bogner et al. ..... 74/7 A

FOREIGN PATENT DOCUMENTS 94997 3/1968 France .
1570596 5/1969 France .
2331186 11/1975 France .

*Primary Examiner*—Allan D. Herrmann
*Attorney, Agent, or Firm*—Browdy and Neimark

[57] ABSTRACT

An engagement control of the starter pinion for an internal combustion engine starter comprises a solenoid (16) whose mobile core (17) is connected by a helical spring (18) working with traction, to one end of a lever (19) axially moving the starter pinion of the starter for its engagement with the ring gear of the flywheel. Connecting spring (18) comprises an end turn (38) brought close to the preceding turn in a plane perpendicular to the axis (14) of spring (18), and widened, which is supported and held against an annular shoulder (40) of the central bore (39) of the mobile core (17).

5 Claims, 4 Drawing Figures

ENGAGEMENT CONTROL OF THE STARTER PINION FOR INTERNAL COMBUSTION ENGINE STARTER

FIELD OF THE INVENTION

This invention relates to an engagement control of the starter pinion for an internal combustion engine starter and more particularly for a motor vehicle starter.

BACKGROUND OF THE INVENTION

In starters for internal combustion engines, an electric motor drives in rotation, directly or by a reduction gear, a device called a "Bendix starter" comprising a pinion that is made to engage with a starting ring gear usually located on the flywheel. The starter pinion is driven in rotation by a freewheeling driver and can be moved axially along its shaft to be able to engage with the ring gear and to separate from this gear after starting of the internal combustion engine.

Engagement of the starter pinion is often controlled from a solenoid placed parallel to the electric starter motor. The mobile solenoid core is connected at one end of a lever whose other end, shaped like a fork, is connected to a part of the Bendux starter called a "driver." When the solenoid coil is actuated, the mobile core is moved along its axis, and controls the pivoting of the lever, which causes the axial movement of the Bendix starter, causing the pinion to engage the ring gear.

In the device for controlling the engaging of the starter pinion, it is advisable to provide a "tooth to tooth" spring to allow, in all cases, the complete travel of the mobile core of the solenoid which, at the end of travel, also closes the electric power supply contacts of the starter motor and, for this reason, is also called a "contactor." The "tooth to tooth" spring should store the energy necessary for penetration of the teeth of the starter pinion in that of the ring gear, after this pinion has been put in rotation.

In a particular type of starter, the mobile core of the solenoid is connected to the first end of the lever by a helical spring working with traction and constituting the "tooth to tooth" spring, which constitutes an advantageous simplification—see French Certificate of Addition No. 94,997of French Pat. No. 1,570,596. However, it is advisable to connect one end of the spring to the lever and to connect its other end to the mobile core. For fastening the spring to the mobile core, the French Certificate of Addition cited above provides a screw on whose threads the last turns are held, the screw itself being held by a bushing crimped in the core. There are also starters in which the spring comprises, at its end located on the side of the mobile core, a hooking loop requiring a crosswise holding element, going through the loop. Present solutions are complicated from the viewpoint of the structure and assembly operations that are required.

SUMMARY OF THE INVENTION

The present invention eliminates these drawbacks by providing an extremely simple means for the connection between the spring and the mobile core.

For this purpose, according to the invention, at least the last turn, located on the solenoid mobile core side, of the connecting spring between the mobile core and the lever is brought close to the preceding turn to be made plane and perpendicular to the axis of the spring, and widened in diameter, to be supported and held against an annular shoulder made in the central bore of the mobile core. This annular shoulder can be formed on the wall of the bore itself.

It is seen that this mode of connection is particularly simple since it does not require any special part and merely requires giving a particular shaping to the end of the spring, and a central bore in the mobile core.

In a particular embodiment of the invention, the end turn or turns, brought close together and widened, of the connecting spring between the mobile core of the solenoid and the lever is or are immobilized between the annular shoulder of the central bore of the mobile core with a washer or disk sunk in the bore, the mobile core acting by means of the washer or disk on a sliding rod carrying a mobile contact for power supply to the electric starter motor. The washer or disk thus assures total holding of this spring, and also enables the mobile core to perform all its usual functions very simply.

In another embodiment of the invention, the annular shoulder for holding the end turn or turns of the connecting spring is formed by an end of a bushing mounted in the central bore of the mobile core and crimped in this bore. In this case the end turn or turns of the connecting spring are advantageously immobilized between the end of the bushing and a washer or disk buried in the bore which in addition acts as a support of a contact pressure spring housed in the bore.

BRIEF DESCRIPTION OF THE DRAWINGS

The invention will be better understood from the following description, with reference to the attached diagrammatic drawing representing, by way of nonlimiting examples, two embodiments of a starter equipped with an engagement control according to the invention.

DESCRIPTION OF PREFERRED EMBODIMENT

Figure 1:
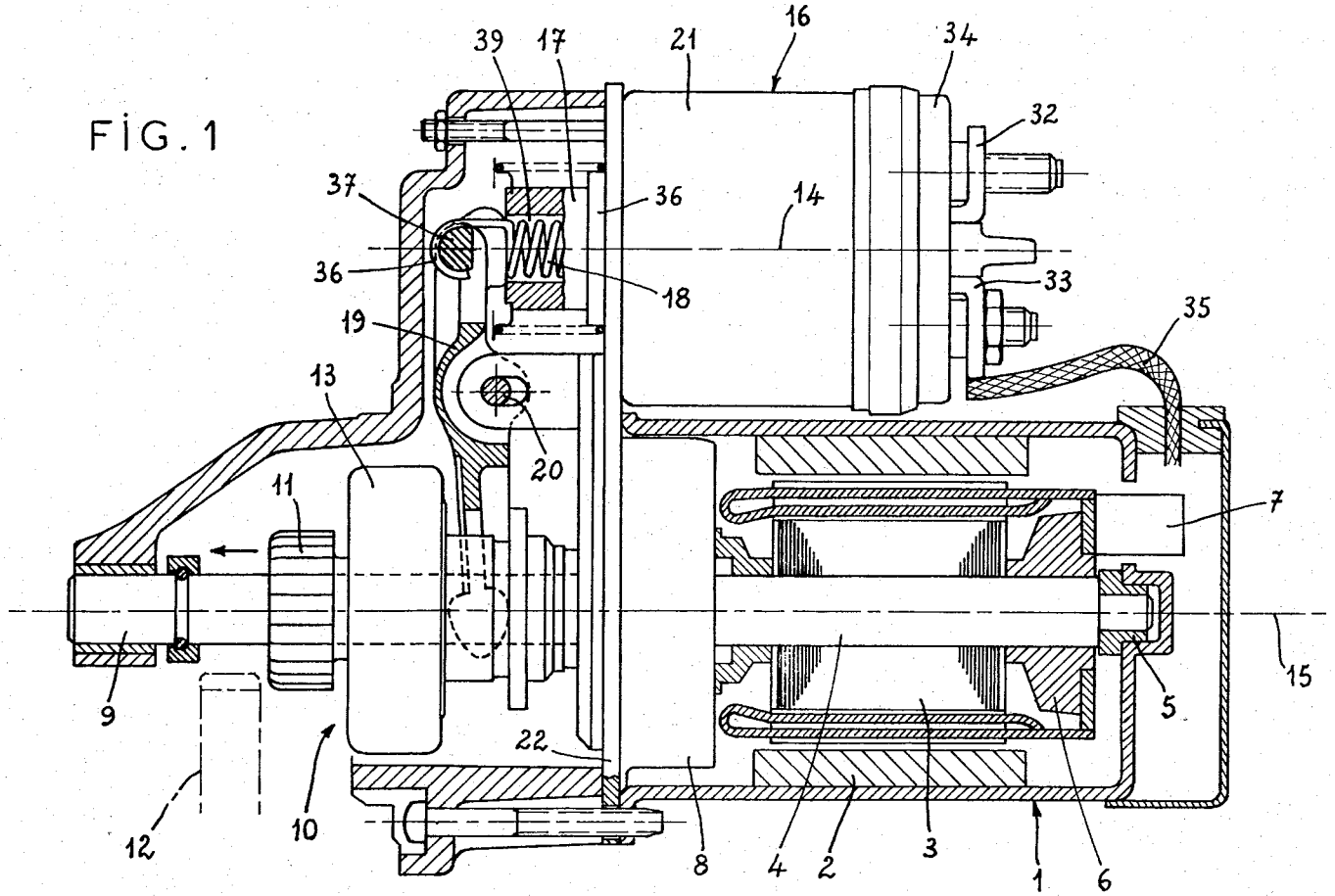
FIG. 1 is an overall view, in longitudinal section, of an internal combustion engine starter.

FIG. 1 represents a motor vehicle starter, comprising a dc motor (1) with a stator (2) and a rotor (3) carried by shaft (4). On the side of one of its bearings (5), shaft (4) carries a commutator (6) on which are applied brushes (7). The opposite end of shaft (4) is coupled, by an epicyclic reduction gear (8), to another shaft (9) on which is mounted a Bendix starter (10), connected in rotation to shaft (9), but able to be moved axially along this shaft (9). In the usual way, the Bendix starter (10) is made up of a pinion (11), able to engage a ring gear (12) located on the flywheel, and of a freewheeling driver (13).

Along an axis (14) parallel to axis (15) of electric motor (1) is placed a solenoid (16) whose mobile core (17) is connected, by a helical spring (18), to one end of a lever (19) mounted to pivot around a pin (20) placed between the two parallel axes (14, 15). The other end of lever (19), shaped like a fork, is connected to driver (13) of Bendix starter (10).

Figure 2:
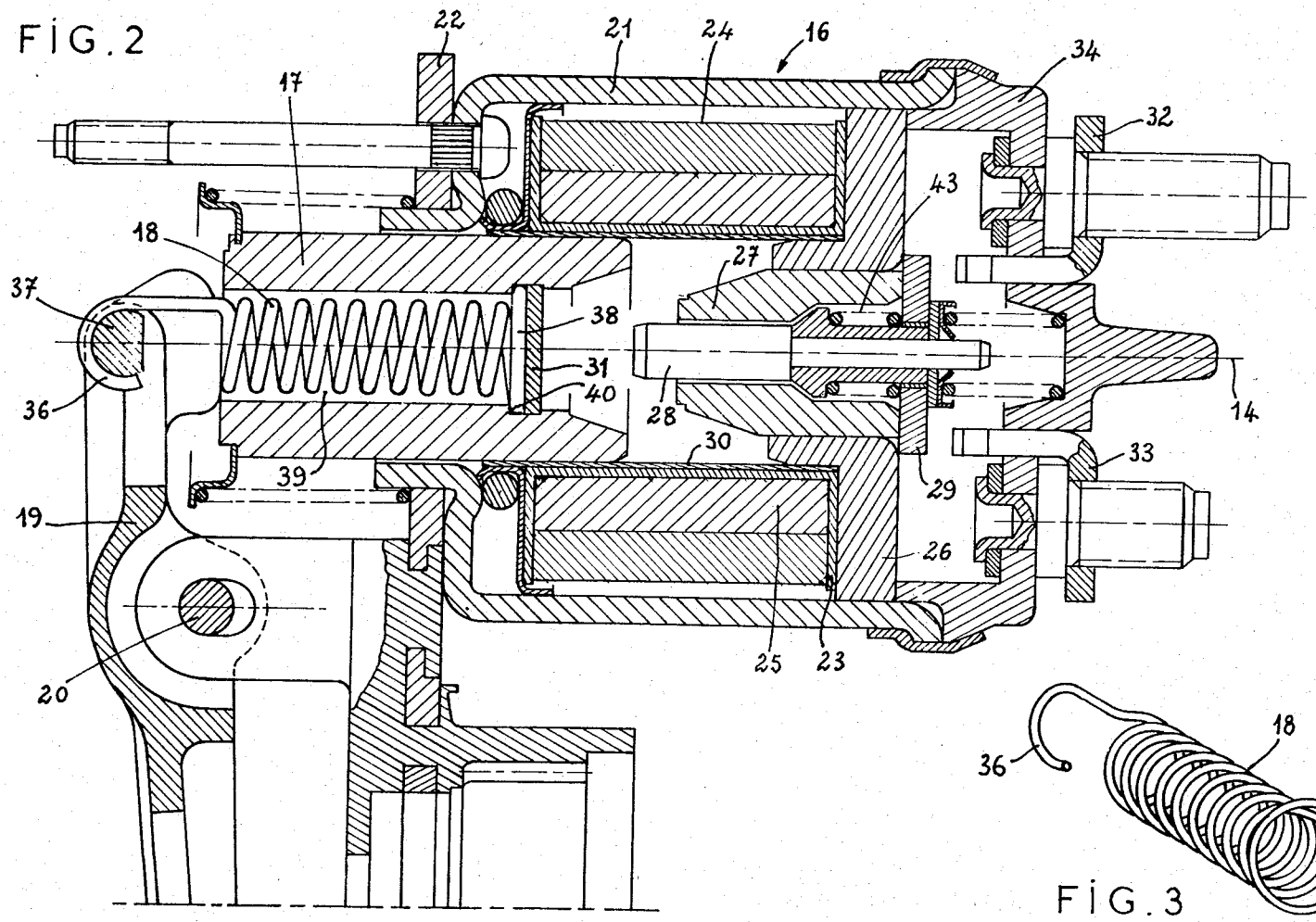
FIG. 2 is a view in section, on a larger scale, showing the details of the solenoid and the connection between this solenoid and the lever, in the starter of FIG. 1.

The internal structure of solenoid (16) is shown in FIG. 2. Solenoid (16) has an outside frame or "pan" (21) fastened to the same support flange (22) as the frame of electric motor (1). On the inside of frame (21) electric windings (24, 25) are mounted around a bobbin (23).

One end of bobbin (23) is fitted on a flange (26) carrying, in its center, a stationary core (27) through which passes a sliding rod (28) carrying a mobile electric contact (29). On the inside of bobbin (23) is placed a guide tube (30) in which mobile core (17) is mounted to slide. When power is supplied to windings (24, 25), mobile core (17) is moved to the right. By connecting spring (18), mobile core (17) makes lever (19) pivot around pin (20), hence an axial movement of driver (13) of Bendix starter (10), bringing pinion (11) to engage with ring gear (12). Simultaneously, a washer or small disk (31), inserted in mobile core (17), shoves rod (28), which is mounted to slide in stationary core (27) so that mobile contact (29) establishes an electric connection between two stationary contacts (32, 33), carried by a closing cap (34) of solenoid (16). Closing of contacts (29, 32, 33) makes it possible to supply power to electric starter motor (1) by a connecting conductor (35) connected to one of stationary contacts (33)—see FIG. 1.

Helical spring (18) providing the mechanical connection between mobile core (17) and one end of lever (19), is a spring working with traction and having a "tooth to tooth" spring function, i.e., the tension of this spring (18) assures reliable engagement of pinion (11) of Bendix starter (10) with ring gear (12), even if the respective teeth are not in perfect correspondence when pinion (11) comes in contact with ring gear (12).

Figure 3:
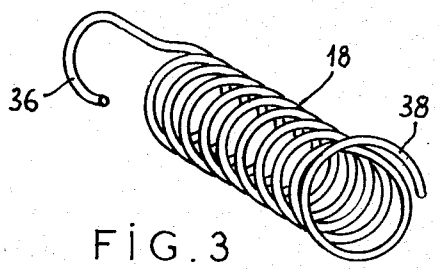
FIG. 3 shows, in perspective, the connecting spring between the mobile core and the lever.

As particularly shown in FIGS. 2 and 3, spring (18) comprises, at one end, a loop (36) which is engaged around a part (37) of the end of lever (19). At its other end, spring (18) comprises a last turn (38) brought close to the preceding turn, i.e., located in a plane perpendicular to axis (14) of spring (18) and not wound in a helix, and which, moreover, is widened in diameter in comparison with the other coils of this spring (18).

Mobile core (17) exhibits, on the wall of its central bore (39), through which spring (18) passes, an annular shoulder (40) against which the last widened turn (38) of spring (18) rests. Actually, this turn (38) is held between shoulder (40) and washer or disk (31) by which mobile core (17) acts on contact-holder rod (28).

Figure 4:
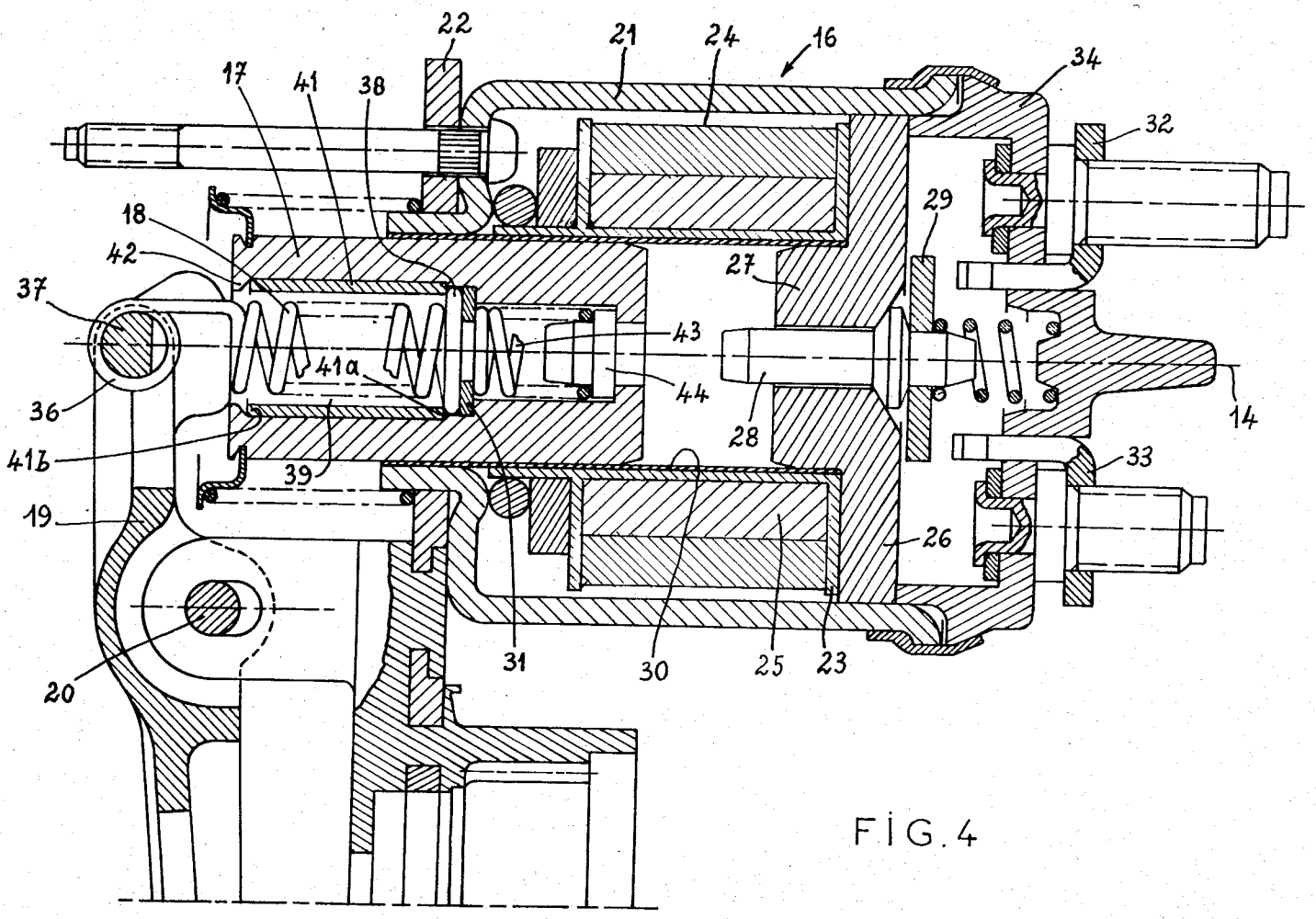
FIG. 4 is a view in section similar to that of FIG. 2, relating to another embodiment.

FIG. 4 shows another embodiment, in which the central bore (39) of the mobile core (17) does not have a shoulder (40) formed directly on its wall, but is provided with an attached part in the form of a bushing (41) whose one end (41*a*) achieves the equivalence of the shoulder (40): the last turn (38) of spring (18) which is, brought close and widened in diameter, is actually held between end (41*a*) of bushing (40) and a washer (31). On the side of its other end (41*b*), bushing (41) is held in bore (39) by a crimping (42).

By its face opposite to the connecting spring (18), washer (31) also serves as a support for a contact pressure spring (43), also housed in a part of bore (39) and acting on a pin (44) which works with sliding rod (28) carrying mobile contact (29). Thus a mobile core (17) is obtained with a flat end, containing contact pressure spring (43) which in the case of FIG. 2 is outside of the mobile core.

To compare the two embodiments described, it can again be noted that in the case of FIG. 4, connecting spring (18) is introduced into mobile core (17) by the end of this latter located on the side of lever (19), while in the case of FIG. 2 spring (18) is introduced by the opposite end of mobile core (17).

Of course, the invention is not limited to the sole embodiments of this engagement control which have been described above, by way of example; on the contrary, it takes in all variant embodiments and applications. Thus, it would not be departing from the spirit of the invention to bring two or more end turns of the connecting spring close together and widen them instead of only the last turn. Moreover, the invention is in no way limited to starters with reducing gear inserted between the motor and Bendix starter, and is also applies to starters not having a reducing gear.

What is claimed is:

1. Engagement control of the starter pinion for a starter of an internal combustion engine, more particularly for the starter of a motor vehicle, including a pinion (11) of the starter (10) axially movable for engagement with a starting ring gear (12) of the internal combustion engine, a solenoid (16) having a mobile core (17) with a central bore (3), a helical spring connected between said core (17) and one end of a lever (19), the lever having another end connected to the drive 13 of the starter (10), said engagement control comprising:

at least one end turn (38) of said helical spring (18), located on the side of said mobile core (17) of said solenoid (16), opposite said lever (19) being brought close to the preceding turn located in a plane perpendicular to the axis (14) of said spring (18), and widened in diameter, to be supported and held against an annular shoulder (40,41*a*) formed in said central bore (39) of said mobile core (17).

2. Engagement control of the starter pinion for a starter according to claim 1, wherein said annular shoulder (40) for holding said at least one end turn (38) of said connecting spring (18) is formed on the wall of said central bore (39) of said mobile core (17).

3. Engagement control of the starter pinion for a starter according to claim 2, wherein said at least one end turn (38), brought together and widened, of said connecting spring (18) is immobilized between said annular shoulder (40) of said central bore (39) of said mobile core (17) and a washer or disk (31) sunk in said central bore (39), said mobile core (17) acting by said washer or disk (31) on a sliding rod (28) carrying a mobile contact (29) for power supply of a starter motor (1).

4. Engagement control of the starter pinion for a starter according to claim 1, wherein said annular shoulder for holding said at least one end turn (38) of said connecting spring (18) is formed by an end (41*a*) of a bushing (41) mounted in said central bore (39) of said mobile core (17), and crimped (at 42) into said bore (39).

5. Engagement control of the starter pinion for a starter according to claim 4, wherein at least one end turn (38) of said connecting spring (18) is immobilized between the end (41*a*) of said bushing (41) and a washer or disk (31) sunk in bore (39), which further acts as a support for a contact pressure spring (43) housed in said bore (39).

* * * * *